US009061854B2

(12) United States Patent
Wells

(10) Patent No.: US 9,061,854 B2
(45) Date of Patent: Jun. 23, 2015

(54) TAPE DISPENSER

(71) Applicant: Garth Wells, Vernon, CA (US)

(72) Inventor: Garth Wells, Vernon, CA (US)

( * ) Notice: Subject to any disclaimer, the term of this patent is extended or adjusted under 35 U.S.C. 154(b) by 145 days.

(21) Appl. No.: 13/789,642

(22) Filed: Mar. 7, 2013

(65) Prior Publication Data

US 2013/0233962 A1 Sep. 12, 2013

Related U.S. Application Data

(60) Provisional application No. 61/607,811, filed on Mar. 7, 2012.

(51) Int. Cl.

| | |
|---|---|
| ***B65H 59/02*** | (2006.01) |
| ***B65H 16/00*** | (2006.01) |
| ***B65H 75/16*** | (2006.01) |

(52) U.S. Cl.

CPC ..... *B65H 16/005* (2013.01); *B65H 75/16* (2013.01); *B65H 2402/41* (2013.01); *B65H 2402/443* (2013.01); *B65H 2402/631* (2013.01); *B65H 2701/11332* (2013.01); *B65H 2701/37* (2013.01); *B65H 2701/537* (2013.01)

(58) Field of Classification Search

USPC ..... 242/588, 588.2, 588.3, 588.6, 405, 242/405.3, 423, 423.1, 423.2, 396, 396.1, 242/396.2, 396.4, 396.9, 601

See application file for complete search history.

(56) References Cited

U.S. PATENT DOCUMENTS

| | | | | |
|---|---|---|---|---|
| 1,837,180 | A | 4/1930 | Bennett, Jr. et al. | |
| 1,858,371 | A * | 5/1932 | Lutz | 242/423.1 |
| 2,444,117 | A | 6/1948 | Sloane et al. | |
| 3,026,052 | A | 3/1962 | Wade | |
| 3,050,853 | A | 8/1962 | Domeny | |
| 3,216,634 | A | 11/1965 | Lausa | |
| 3,320,342 | A | 5/1967 | Binson et al. | |
| 3,424,435 | A | 1/1969 | Niemann | |
| 3,470,781 | A | 10/1969 | Domeny | |
| 3,508,998 | A | 4/1970 | Bilbrey | |
| 3,893,636 | A | 7/1975 | Wise et al. | |
| 3,942,736 | A | 3/1976 | Ramos | |
| 3,971,280 | A | 7/1976 | Inka | |
| 4,012,273 | A | 3/1977 | Inka | |
| 4,026,748 | A | 5/1977 | Wise et al. | |
| 4,400,231 | A | 8/1983 | Martin | |
| 4,542,863 | A | 9/1985 | Larson | |
| 5,171,397 | A | 12/1992 | Arnold | |
| 5,358,113 | A | 10/1994 | Hellenbrand | |
| 5,735,400 | A | 4/1998 | Packard | |
| 6,015,110 | A * | 1/2000 | Lai | 242/388.1 |
| 6,048,118 | A * | 4/2000 | Martinez et al. | 400/208 |

(Continued)

*Primary Examiner* — William A Rivera
(74) *Attorney, Agent, or Firm* — Richard D. Okimaw

(57) ABSTRACT

An apparatus and method for dispensing non-adhesive tape to an article. The apparatus comprises a spool having the non-adhesive tape wound therearound and having a spool bore therethrough. The spool bore is adapted to rotatably receive a support member therein. The apparatus further includes a casing having an interior cavity sized to resistively and rotatably receive the spool therein and a dispenser portion located in the casing for dispensing the non-adhesive tape therethrough. The apparatus may further comprise a finger hub rotatably receivable within the spool bore. The method comprises securing a free end of the non-adhesive tape to the article through a dispenser portion of the casing and rotating the casing around the article with the dispenser portion maintained in radial alignment with the article so as to draw the non-adhesive tape though the dispensing portion and thereby to rotate the spool within the casing.

15 Claims, 7 Drawing Sheets

(56) References Cited

U.S. PATENT DOCUMENTS

| | | | | |
|---|---|---|---|---|
| 6,542,511 | B1 | 4/2003 | Livermore et al. | |
| 6,543,511 | B2 | 4/2003 | Niermann | |
| 6,612,474 | B2 | 9/2003 | Shah | |
| 7,040,370 | B2 | 5/2006 | Miller | |
| 7,175,062 | B2 | 2/2007 | Shah | |
| 8,201,769 | B2 * | 6/2012 | Agullo | 242/588.6 |

* cited by examiner

TAPE DISPENSER

CROSS REFERENCE TO RELATED APPLICATION

This application claims priority to U.S. Provisional Patent Application No. 61/607,811 filed Mar. 7, 2012 entitled Tape Dispenser.

BACKGROUND OF THE INVENTION

1. Field of Invention

The present invention relates to dispensing tape in general and in particular to a method and apparatus for dispensing non-adhesive tapes.

2. Description of Related Art

Pipes are often connected to each other by threaded ends. It is known that for such connections a threaded seal tape is typically used to seal the connection. A commonly used threaded seal tape is polytetrafluoroethylene tape or PTFE tape commonly known as plumbers tape or Teflon® tape. PTFE tape is typically sold in a roll having a hole through the middle. In use, the PTFE tape may be wrapped around the exposed end of the threads of a pipe before it is screwed into an adjoining connector or pipe. A typical method of wrapping PTFE tape is for the user to grip the roll of PTFE tape between their thumb and one of their fingers. The user may then apply frictional resistance to the unwinding of the tape by squeezing the roll of PTFE tape therebetween.

PTFE tape is known to have low friction for lubricating the connection between the pipes. PTFE tape also typically does not use an adhesive to secure it to the pipe, but rather while the PTFE tape is being wrapped around the pipe, tension is applied to the tape to pull the tape into the threads and plastically deforms the tape to the threads.

A common problem with PTFE tape is the fact that it lacks an adhesive. This may result in the tape freely unraveling from the roll if it is inadvertently released by the user. This may result in excessive amounts of tape unwound from the roll which may then become dirty or tangled. Such tangled portions of the tape are often discarded and therefore wasted.

An additional difficulty with PTFE tape is the fact that it is applied by the user applying a tension to the tape so as to deform the tape into the threads. Because PTFE tape has no adhesive and therefore no resistance to being freely unwound from the roll, the PTFE tape itself does not provide a tension to the tape to secure it to the threads. It is therefore required that the user apply an appropriate level of tension to the tape for application to the threads. Tension is typically applied by the user maintaining a frictional grip on the roll as the tape is unwound therefrom. The user may therefore control the amount of friction applied to the tape by controlling their grip on the roll. This may be difficult to accurately or consistently control in many situations or for people with less experience and practice.

It is also commonly difficult to find an end of a roll of PTFE tape. This is due to the PTFE tape being relatively soft so that the end may be prone to being compressed against the roll so as to compress the end therein. The difficulty in finding the end may be exacerbated or caused by another common difficulty of PTFE tape of losing the snap on cove. PTFE tape is commonly sold in a roll with a cover sized to snap over the roll and thereby protect the roll when not in use. As the cover is removed from the roll during use, it may be prone to loss thereby permitting the uncovered roll to be compressed by other objects within the tool box of the user between uses. An additional difficulty with existing PTFE tapes is that depending upon from which direction the finger is inserted through the center hole, the roll will rotate either in the same or opposite direction as the rotation about the pipe as the PTFE tape is applied thereto. This may cause the roll of PTFE tape to be rotated in a direction, during application of the tape to a pipe, in which the PTFE tape is wound onto the roll such that the roll is urged closer to the pipe. In other words, the rotation of the roll of PTFE tape around the pipe may cause the PTFE tape to be wound onto the roll instead of off which will make application of the tape more difficult.

Previous attempts to provide a method and apparatus for applying PTFE tape to pipe threading may be found in International Application No. PCT/CA2009/00436 to Wells, the entirety of which is incorporated herein by reference.

SUMMARY OF THE INVENTION

According to a first embodiment of the present invention there is provided an apparatus for dispensing non-adhesive tape to an article comprising a spool having the non-adhesive tape wound therearound and having a spool bore therethrough. The spool bore is adapted to rotatably receive a support member therein. The apparatus further includes a casing having an interior cavity sized to resistively and rotatably receive the spool therein and a dispenser portion located in the casing for dispensing the non-adhesive tape therethrough.

The casing may have a central axis. The spool may be rotatable about the central axis within the casing. One of the spool or the casing may include a biased protrusion adapted to engage one of a plurality of corresponding notches in the other of the spool or the casing, wherein the plurality of notches are arranged circumferentially around an interior of the casing between the casing and the spool such that rotation of the spool within the casing causes the protrusion to engage successive notches.

The casing may be cup shaped having a bottom disk portion and an annular rim portion extending therefrom, wherein the notches are located on the disk portion, and wherein the protrusions extend axially from the spool.

The spool may include an inner cylinder having a spool axis and sidewalls extending from the inner cylinder perpendicularly to the axis. The protrusions may extend axially from the sidewalls of the spool. The dispenser portion may frictionally bear against the non-adhesive tape passing therethrough.

The support member may comprise a finger of a user. The apparatus may further comprise a finger hub rotatably receivable within the spool bore. The finger hub may include a finger bore extending therethrough operable to receive a finger of a user therein. The finger hub may include catches engageable on edges of the spool bore so as to retain the finger hub therein.

According to a further embodiment of the present invention there is provided a method for dispensing non-adhesive tape to an article comprising providing a spool having the non-adhesive tape wound therearound and a spool bore therethrough, resistively and rotatably supporting a casing around the spool and supporting the spool on a support member located within the spool bore. The method further comprises securing a free end of the non-adhesive tape to the article through a dispenser portion of the casing and rotating the casing around the article with the dispenser portion maintained in radial alignment with the article so as to draw the non-adhesive tape though the dispensing portion and thereby to rotate the spool within the casing.

The supporting the spool on a support member may comprise supporting the spool on a finger of a user. The dispensing portion compressibly grips the non-adhesive tape.

The spool bore may rotate on the support member. The method may further comprise providing a finger hub rotatably supported within the spool bore wherein the finger hub receives a finger of a user therein.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 6A:
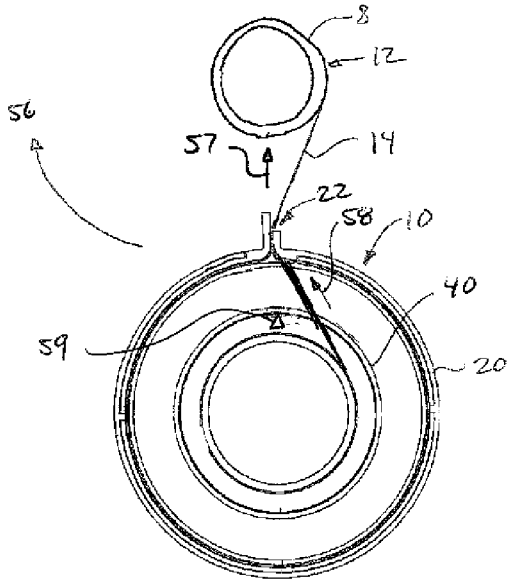
FIG. 6*a* is a side elevation view of the apparatus of FIG. 1 applying PTFE tape to a pipe at a first position.
Figure 6B:
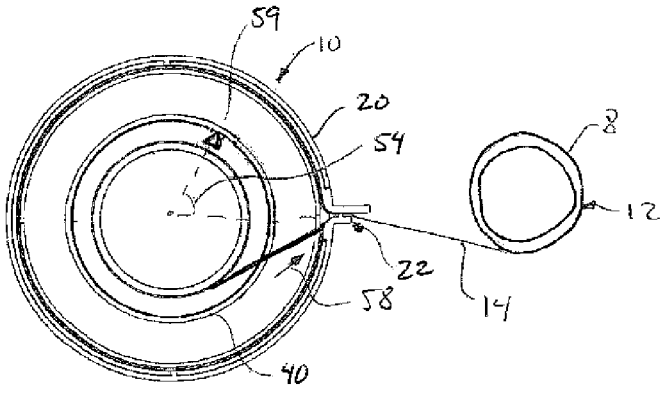
FIG. 6*b* is a side elevation view of the apparatus of FIG. 1 applying PTFE tape to a pipe at a second position.

Referring to FIGS. 6*a* and 6*b*, pipes 8 commonly include a threaded end 12 for securing to fittings and other pipes. The threaded end 12 may be wrapped with a thread seal tape or PTFE tape 14 to seal the resulting connection. An apparatus according to a first embodiment of the invention for applying an adhesiveless tape to an article is shown generally at 10 applying PTFE tape to the threaded end 12 of the pipe 8. Although the apparatus of the present invention is illustrated and described as applying PTFE tape to threads of a pipe, it will be appreciated that other kinds of adhesiveless tape may also be applied by the present apparatus, including, by way of non-limiting example, ribbon or other types of thread seal tape.

Figure 1:
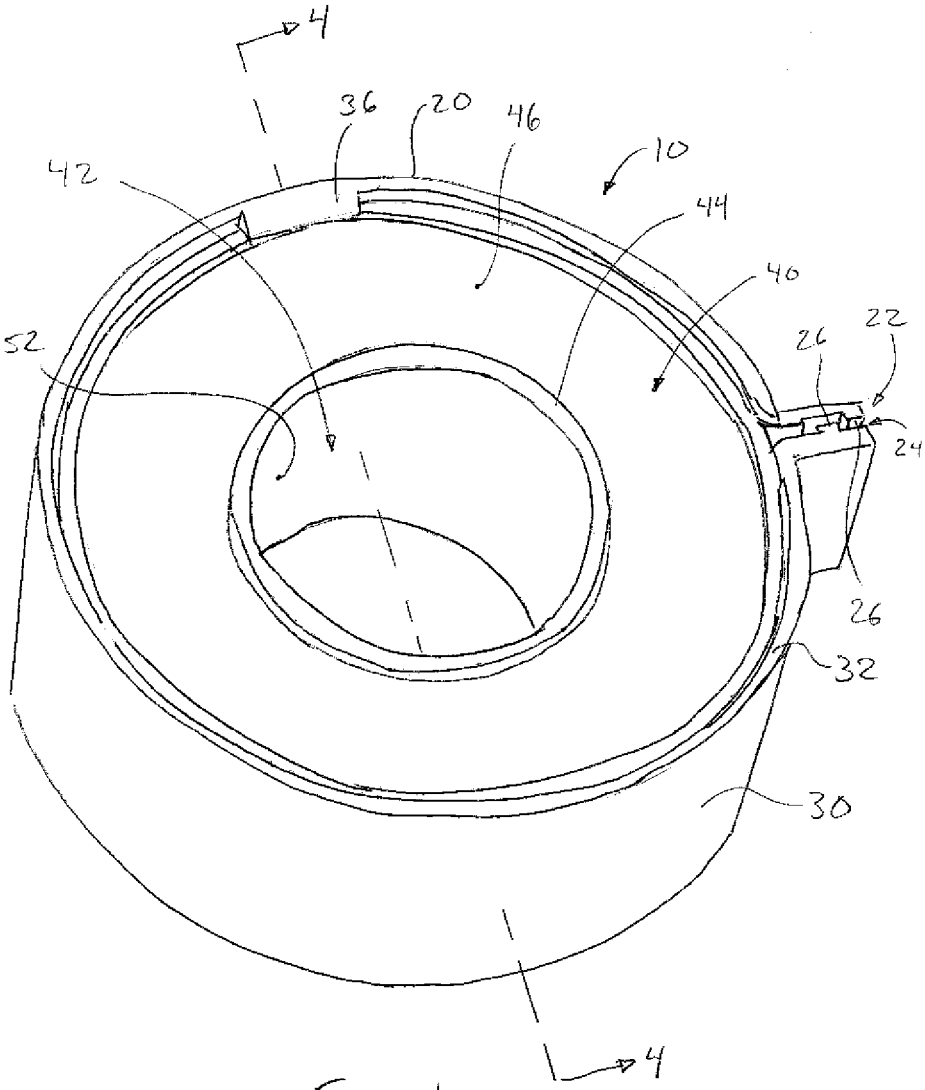
FIG. 1 is a perspective view of an apparatus according to the present invention applying an adhesiveless tape to the threads of a pipe.

With reference to FIG. 1, apparatus 10 comprises a casing 20 rotatably and resistibly supporting a spool 40 of PTFE tape therein having a finger hole 42 therethrough for receiving the finger of a user. The apparatus 10 may also include a dispensing portion 22 having a slot 24 there through for receiving PTFE tape to be applied to the treaded end 12 of the pipe 8. In some embodiments, the slot 24 may squeeze or bear upon the PTFE tape as it passes therethrough for the purposes of guiding the PTFE tape such as, for example with alternating ribs 26 as illustrated in FIG. 1 so as to present a non-straight line path of travel for the PTFE tape. The ribs 26 assist in maintaining the PTFE tape within the slot 24 and keep it from wandering out of the slot 24 as the PTFE tape is withdrawn from the apparatus 10. As illustrated in FIG. 1, the slot 24 of the dispensing portion 22 may also be open to one side adjacent to the opening in the casing for receiving the spool for feeding the PTFE tape through. The slot 24 may optionally also include a narrowing or reduced width portion so as to frictionally compress the PTFE tape as it passes therethrough according to well known methods. This may serve to keep the free end of the PTFE tape available for future use as well as to provide tension to the PTFE tape for to ensure proper application to the threaded end 12 of the pipe 8. By way of non-limiting example, common examples of such devices which may provide such compression to the PTFE tape include springs, nozzles, wedges and pads.

In operation, a user may place their finger through the finger hole 42 and apply an end of the PTFE tape to the threaded end 12. Thereafter the user may run their finger in a substantially circular motion around the threaded end as indicated by arrow 56 in FIG. 6*a* such that the dispensing portion 22 is maintained as the most proximate portion of the apparatus 10 to the threaded end 12. After application to the pipe the user may tear off the applied PTFE tape. The free end of the PTFE tape extending from the apparatus 10 will thereafter remain extending from the apparatus for the next use. As such, it will not be necessary to free the free end of the PTFE tape from the roll as is required in existing rolls. Accordingly, it will be appreciated that the apparatus 10 is retained in a radial orientation as indicated by the arrow 57 about the threaded end 12 of the pipe 8 by the PTFE tape 14 remaining in radial alignment with the pipe 8.

Figure 2:
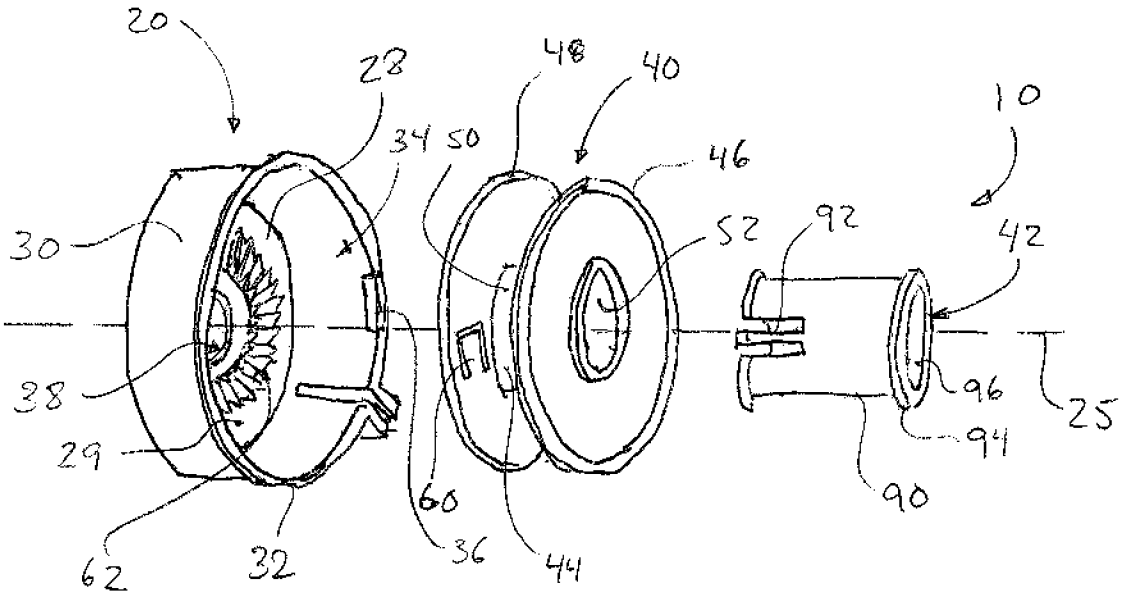
FIG. 2 is an exploded perspective view of the apparatus of FIG. 1.

Turning to FIG. 2, an exploded view of one embodiment of the apparatus 10 is illustrated. The apparatus 10 includes a casing 20 and a spool 40. As illustrated in FIG. 1, the spool 40 of PTFE tape is retained within the casing and carries a length of PTFE tape wound thereon for distribution through the dispensing portion 22. The casing 20 includes a backing plate 28 and an enclosing wall 30 having a distal edge 32 extending around the periphery thereof. As illustrated the backing plate 28 has a circular outline although it will be appreciated that other shapes may be useful as well, such as for example, cup-shaped, square or rectangular. The enclosing wall 30 defines a void 34 therein having a diameter sized to receive the spool 40 therein. The enclosing wall also has a height sufficient to retain the spool 40 within the void 34. The enclosing wall 30 may also include one or more clips 36 extending radially inwardly at one or more locations along the distal edge 32 of the enclosing wall 30.

The spool 40 of PTFE tape 14 comprises a central cylinder 44 first and second side plates, 46 and 48, respectively at opposed ends thereof. The PTFE tape 14 is wound around the central cylinder 44 between the first and second side plates 46 and 48. It will be appreciated that the PTFE tape 14 may be wound directly onto an outer surface 50 of the central cylinder 44. Optionally, the PTFE tape 14 may be wound onto a disposable cylinder that is secured to the central cylinder 44 such that existing spools of PTFE tape 14 may be used in the current apparatus without modification or such that replacement spools of PTFE tape may be inserted into the apparatus 10.

Figure 7:
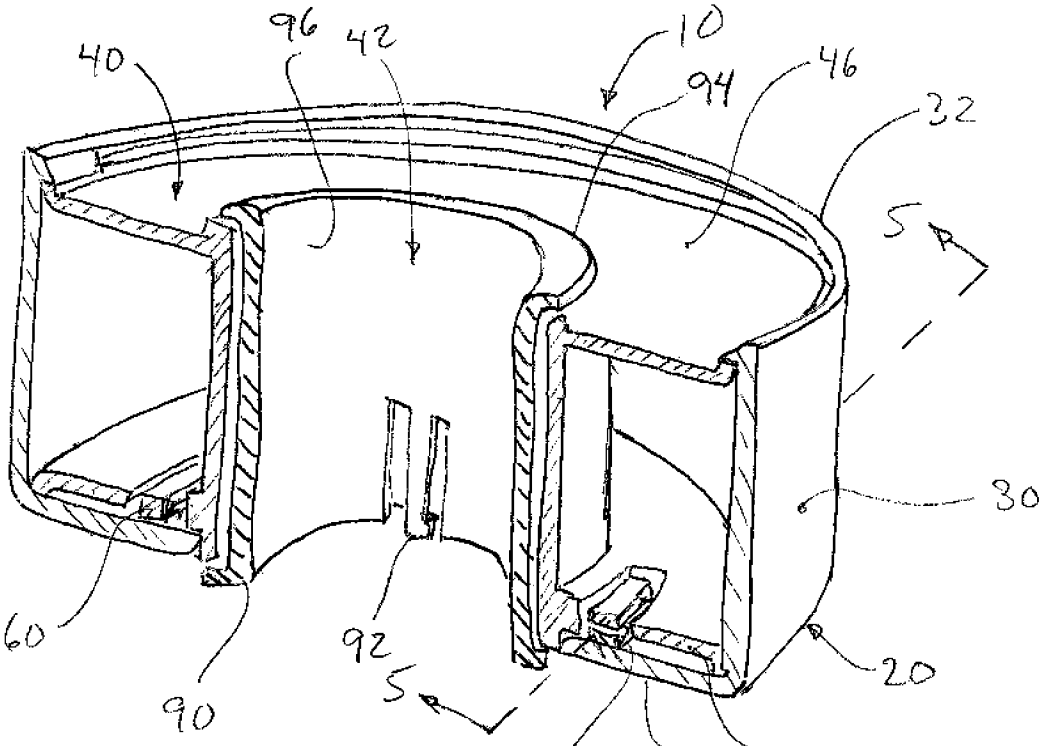
FIG. 7 is a cross-sectional view of the apparatus of FIG. 1 taken along the line 4-4 having an optional finger hub according to a further embodiment of the apparatus.

The apparatus 10 may also include an optional finger hub 90. The finger hub 90 comprises a substantially cylindrical member sized to be received within the central cylinder 44 of the spool 40. The finger hub 90 includes at least one catch 92 and a top rim 94 for selectably retaining the finger hub 90 within the central cylinder 44 as illustrated in FIG. 7. As illustrated, in embodiments including a finger hub 90, the finger hole 42 will be defined a bore 96 through the finger hub whereas in embodiments without the finger hub the finger hole 42 will be defined by the central cylinder as described above. It will be appreciated that for embodiments including the finger hub 90, the finger hub may be rotatable relative to the spool 40 so as to permit the spool rotate around the finger of the user as the PTFE tape is applied to the pipe 8. The finger hub 90 may also include a finger gripping means, such as, by way of non-limiting example, a rubber wall, foam pad or elastic stretched across the finger hole as are commonly known.

The apparatus 10 is assembled by locating the spool 40 of PTFE tape 14 within the void 34 of the casing with the second side plate 48 adjacent to the backing plate 28. The first side plate 46 in such a location is engaged by the clips 36 so as to retain the spool 40 within the void 34. The clip 36 may be sized to overlap and retain the spool 40 within the void 34. The clips 36 may also be positioned so as to compress the spool 40 into the void 34 so as to ensure proper engagement of the resistive device as will be further described below.

It will be appreciated that in order to remove the spool 40 from the casing 20, the clips 36 must first be disengaged by pulling the clips in a radially outward direction so as to disengage them from the spool 40. The second plate 48 of the spool 40 may also include a raised rim 49 adjacent to the finger hole 42. The raised rim may be recievable within the central bore 38. When removing the spool 40 from the casing 20, the raised rim may also be utilized to push the spool out of the casing. As illustrated, when assembled the casing 20 and spool 40 of PTFE tape 14 are coaxial a common axis 25. An inner surface 52 of the central cylinder 44 defines the finger hole 42. The backing plate 28 includes a central bore 38 corresponding to the finger hole 42 such that a user may pass their finger through both opening so as to support the apparatus 10 thereon. After the spool 40 is located within the casing 20, a free end of the PTFE tape 14 may be pulled into the slot 24 so as to extend from the dispensing portion for use by a user.

Referring to FIGS. 6*a* and 6*b*, the spool 40 of PTFE tape 14 is rotatable relative to the casing 20 such that the PTFE tape 14 may be unspooled therefrom as indicated by arrow 58. As shown in FIGS. 6*a* and 6*b*, the apparatus 10 is illustrated in a plurality of positions while dispensing PTFE tape 14 to the threaded end 12 of a pipe 8. As illustrated in FIG. 6*a*, the apparatus is oriented below the pipe 8 such that the dispensing portion 22 is oriented at the uppermost portion of the apparatus 10 proximate to the pipe 8. For illustration purposes only, an indicator 59 is shown in FIG. 6*a*, which is radially aligned within dispensing portion 22 and the pipe 8. As illustrated in FIG. 6*b*, the apparatus 10 has now been circumferentially moved around the pipe 8 wherein the dispensing portion 22 is now oriented to the side of the apparatus 10 but still in the most proximate position to the pipe. It will be observed that between the positions illustrated in FIGS. 6*a* and 6*b*, the spool 40 of PTFE tape 14 has rotated relative to the casing 20 in the course of unwinding the PTFE tape 14 from the spool 40. The amount of rotation between the spool 40 and the casing 20 is illustrated by angle 54 between the indicator 59 and the dispensing portion 22. It will be appreciated that as the apparatus 10 is rotated about the pipe 8, the spool 40 rotates within the casing 20 and therefore the spool will also rotate on the finger of a user. It will also be appreciated that due to the casing 20 remaining on the spool during and in between uses, the present apparatus will reduce the risk of loss of the casing.

The amount of resistance between the spool 40 of PTFE tape 14 and the casing 20 is provided by a resistive device as further described below and should be selected to prevent the PTFE tape 14 from freely unrolling. In practice the amount of resistance between the spool 40 of PTFE tape and the casing 20 should be selected such that the PTFE tape 14 will not freely unravel from the apparatus 10 should the apparatus be dropped by the user. Put another way, the amount of resistance between the PTFE tape and the backing body constitutes a braking mechanism and should be sufficient to support the weight of the apparatus 10 and the spool 40 of PTFE tape 14 when the apparatus is suspended by a free end of the PTFE tape 14.

In some embodiments, the amount of resistance between the spool 40 of PTFE tape 14 and the backing body should be selected to ensure that a desired amount of tension is applied to the PTFE tape 14 when in use by a user such that the PTFE tape 14 is embedded within the threads of the pipe 8. The amount of resistance should also be selected to be high enough to support the weight of the apparatus 10 with a full spool 40 of PTFE tape 14 includes so as to prevent the unwinding of the PTFE tape 14 from the apparatus should the user let go of the apparatus when a free end of the PTFE tape is secured to the article. In addition, the amount of tension applied to the PTFE tape 14 should be less than the tensile strength of the PTFE tape 14 so as to prevent unwanted breaking of the PTFE tape during application to an article. It will be appreciated that the actual amount of resistance provided by the apparatus should therefore be selected based upon the type, width and thickness of the adhesiveless tape with which the apparatus is intended to be used.

Figure 3:
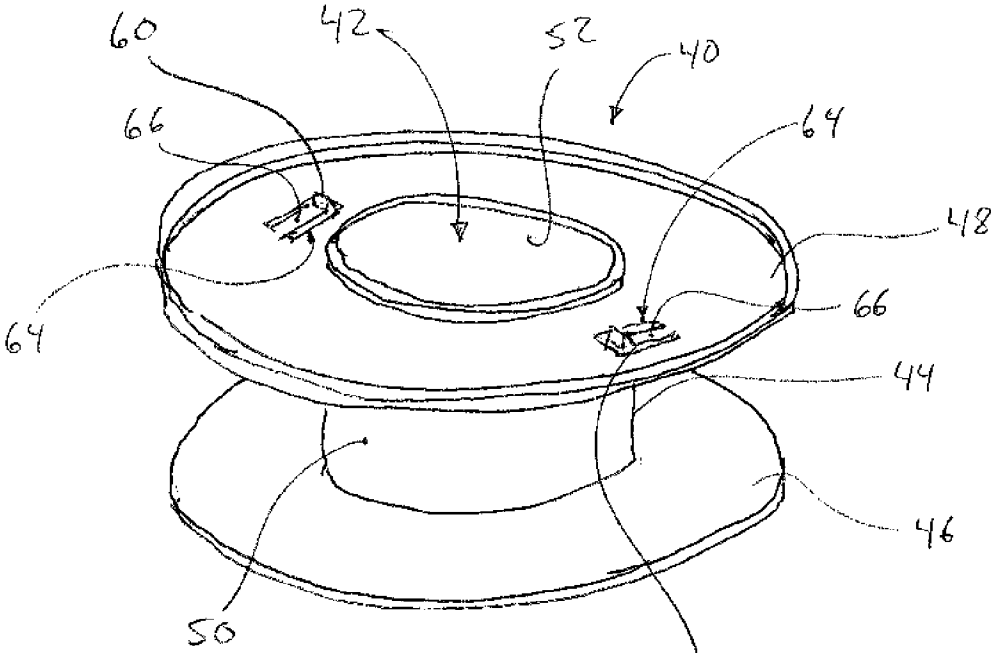
FIG. 3 is a perspective view of the spool of the apparatus of FIG. 1.
Figure 4:
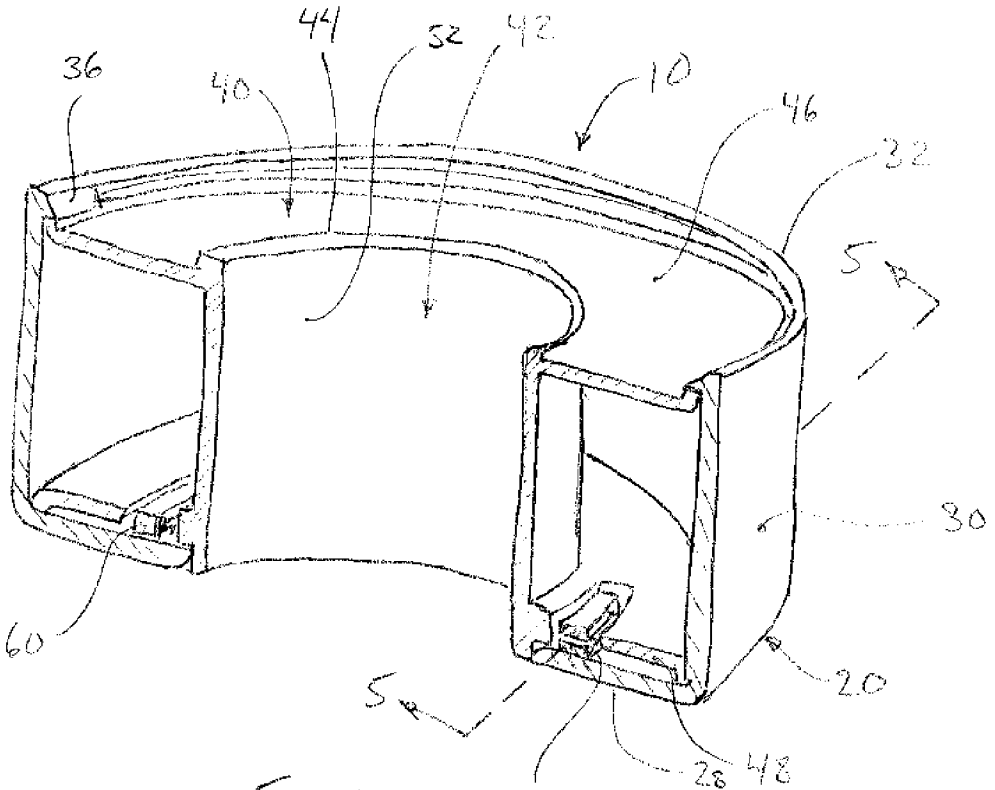
FIG. 4 is a cross-sectional view of the apparatus of FIG. 1 taken along the line 4-4 showing an indexed resistor according to a first embodiment of the apparatus.

As illustrated in FIG. 2, the resistive device may comprise a protrusion 60 in one of the spool 40 or casing 20 engaged with an indexing ring 62 cooperatively connected to the other of the spool or casing. As illustrated the indexing ring 62 is secured to an inside surface 29 of the backing plate 28 of the casing 20 and annularly surround the central bore 38. The protrusion 60 extends axially from the second plate 48 so as to engage within the indexing ring 62. Turning to FIG. 3, a perspective view of the spool 40 is illustrated from the second side plate 48. Although two protrusions 60 are illustrated in FIG. 3, it will be appreciated that only one protrusion or more than two protrusions may be utilized as well. The second side plate 48 includes a pair of apertures 64 therethrough having cantilevered biasing members 66 extending therein. The biasing members carry the protrusions 60 at a distal end thereof and serve to retain the protrusions in contact with the indexing ring 62 when the apparatus 10 is assembled as illustrated in FIG. 4.

Figure 5:
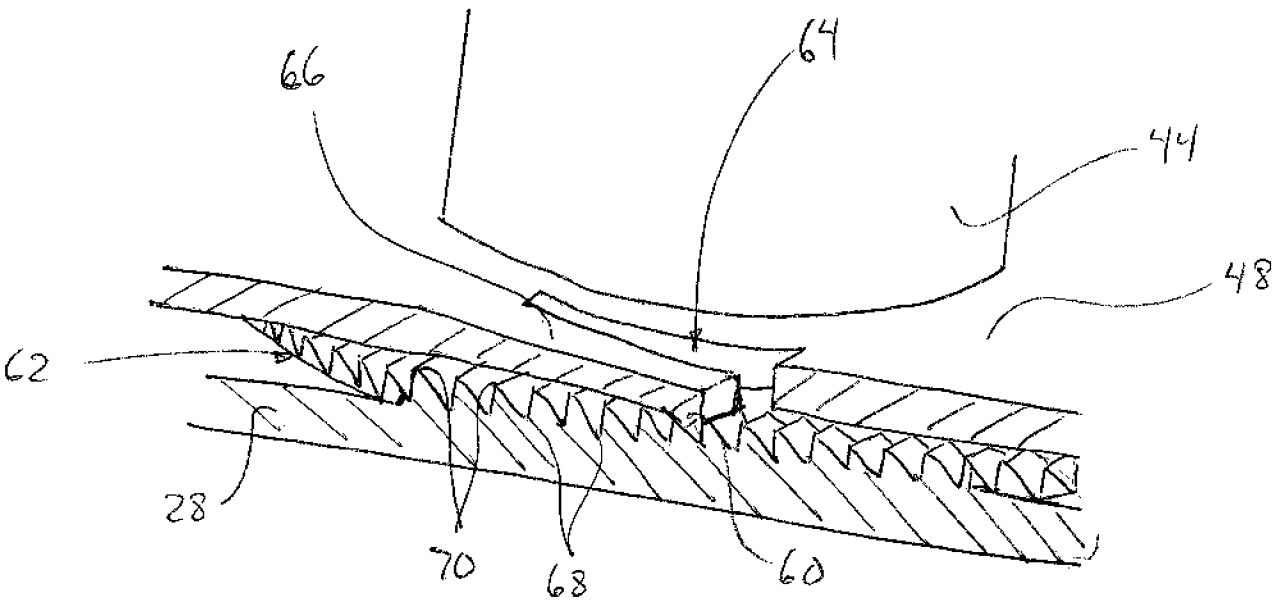
FIG. 5 is a partial cross-sectional view of indexed resister of the apparatus of FIG. 1 taken along the line 5-5.

Turning now to FIG. 5, the indexing ring 62 comprises a plurality of alternating indentations and ridges, 68 and 70, respectively. The protrusion 60 cooperates with the ridges 70 so as to index the motion of the spool 40 relative to the casing 20 as the spool is rotated therein. As illustrated in FIG. 5, the indentations and ridges may form a triangular teeth shaped track wherein the protrusion has a substantially triangular shape corresponding to the indentations and ridges. It will be appreciated that other shapes of the indentations and ridges may be useful as well, such as, by way of non-limiting example, circular or wave shaped. The biasing member 66 may be selected to have a size such that a desired amount of friction is applied on the ridges 70 by the protrusion 60.

It will be appreciated the spool 40 of the present apparatus may be manufactured as replacement for existing PTFE tape rolls and may therefore be disposed after use. In such embodiments the casing 20 may either be reusable with replacement spools or be disposable with the used spools as well.

Although the present disclosure describes polytetrafluoroethylene tape, or PTFE, it will be appreciated that the apparatus and method will be useful in association with other types of adhesiveless tapes as well such as anti-seize tape including, by way of non-limiting example, other PTFE tapes including, PTFE tapes having nickel, copper or ceramics included therein as well as ribbons.

While specific embodiments of the invention have been described and illustrated, such embodiments should be considered illustrative of the invention only and not as limiting the invention as construed in accordance with the accompanying claims.

What is claimed is:

1. An apparatus for dispensing non-adhesive tape to an article comprising:

a spool having said non-adhesive tape wound therearound and having a spool bore therethrough, the spool bore being adapted to rotatably receive a support member therein;

a casing having an interior cavity sized to resistively and rotatably receive the spool therein; and a dispenser portion located in the casing for dispensing the non-adhesive tape therethrough, wherein one said of the spool or said casing includes a biased protrusion adapted to engage one of a plurality of corresponding notches in said other of said spool or said casing, said plurality of notches are arranged circumferentially around an interior of said casing between said casing and said spool such that rotation of said spool within said casing causes said protrusion to engage successive notches.

2. The apparatus of claim 1 wherein said casing has a central axis.

3. The apparatus of claim 2 wherein said spool is rotatable about said central axis within said casing.

4. The apparatus of claim 1 wherein said casing is cup shaped having a bottom disk portion and an annular rim portion extending therefrom, wherein said notches are located on said disk portion, and wherein said protrusions extend axially from said spool.

5. The apparatus of claim 4 wherein said spool includes an inner cylinder having a spool axis and sidewalls extending from said inner cylinder perpendicularly to said axis.

6. The apparatus of claim 5 wherein said protrusions extend axially from said sidewalls of said spool.

7. The apparatus of claim 1 wherein said dispenser portion frictionally bears against said non-adhesive tape passing therethrough.

8. The apparatus of claim 1 further comprising a finger hub rotatably receivable within said spool bore.

9. The apparatus of claim 8 wherein said finger hub includes a finger bore extending therethrough operable to receive a finger of a user therein.

10. The apparatus of claim 8 wherein said finger hub includes catches engageable on edges of said spool bore so as to retain said finger hub therein.

11. A method for dispensing non-adhesive tape to an article comprising:

providing a spool having said non-adhesive tape wound therearound and a spool bore therethrough;

resistively and rotatably supporting a casing around said spool;

supporting said spool on a support member located within said spool bore;

securing a free end of said non-adhesive tape to said article through a dispenser portion of the casing; and rotating said casing around said article with the dispenser portion maintained in radial alignment with the article so as to draw said non-adhesive tape though said dispensing portion and thereby to rotate said spool within said casing, wherein one said of the spool or said casing includes a biased protrusion adapted to engage one of a plurality of corresponding notches in said other of said spool or said casing, said plurality of notches are arranged circumferentially around an interior of said casing between said casing and said spool such that rotation of said spool within said casing causes said protrusion to engage successive notches.

12. The method of claim 11 wherein said supporting said spool on a support member comprises supporting said spool on a finger of a user.

13. The method of claim 11 wherein said dispensing portion compressibly grips said non-adhesive tape.

14. The method of claim 11 wherein said spool bore rotates on said support member.

15. The method of claim 11 further comprising providing a finger hub rotatably supported within said spool bore wherein said finger hub receives a finger of a user therein.

* * * * *